US008896509B2

(12) United States Patent
An et al.

(10) Patent No.: US 8,896,509 B2
(45) Date of Patent: Nov. 25, 2014

(54) LIQUID CRYSTAL DISPLAY DEVICE INCLUDING DATA CONVERTING PART AND METHOD OF DRIVING THE SAME

(75) Inventors: Cheung-Hwan An, Seoul (KR); Eui-Tae Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 322 days.

(21) Appl. No.: 12/899,952

(22) Filed: Oct. 7, 2010

(65) Prior Publication Data

US 2011/0084990 A1 Apr. 14, 2011

(30) Foreign Application Priority Data

Oct. 8, 2009 (KR) ..... 10-2009-0095562

(51) Int. Cl.
*G09G 3/36* (2006.01)

(52) U.S. Cl.
CPC ..... *G09G 3/3648* (2013.01); *G09G 2300/0452* (2013.01); *G09G 2320/0242* (2013.01); *G09G 2320/0606* (2013.01); *G09G 2320/0666* (2013.01); *G09G 2340/06* (2013.01); *G09G 2360/144* (2013.01)
USPC ..... 345/88; 345/690

(58) Field of Classification Search
CPC ..... G09G 2320/0276; G09G 2360/16; G09G 2320/0626
USPC ..... 345/690, 88, 89, 691
See application file for complete search history.

(56) References Cited

U.S. PATENT DOCUMENTS

| | | | | |
|---|---|---|---|---|
| 8,223,180 | B2 * | 7/2012 | Elliott et al. | 345/694 |
| 2005/0168645 | A1 * | 8/2005 | Yamazaki | 348/655 |
| 2007/0024557 | A1 * | 2/2007 | Rho et al. | 345/88 |
| 2007/0063945 | A1 * | 3/2007 | Hung et al. | 345/88 |
| 2007/0200807 | A1 * | 8/2007 | Lee et al. | 345/88 |
| 2008/0204480 | A1 * | 8/2008 | Van Mourik et al. | 345/690 |
| 2009/0102769 | A1 * | 4/2009 | Kouno et al. | 345/88 |
| 2009/0290793 | A1 * | 11/2009 | Engholm et al. | 382/171 |
| 2010/0033456 | A1 * | 2/2010 | Yoshida et al. | 345/207 |
| 2010/0103201 | A1 | 4/2010 | Nakanishi et al. | |

FOREIGN PATENT DOCUMENTS

| | | |
|---|---|---|
| CN | 1551707 | 12/2004 |
| CN | 1862646 A | 11/2006 |

(Continued)

OTHER PUBLICATIONS

Office Action issued in corresponding Chinese Patent Application No. 201010238557.0; Issued May 3, 2012.

(Continued)

*Primary Examiner* — Chanh Nguyen
*Assistant Examiner* — Jonathan Blancha
(74) *Attorney, Agent, or Firm* — Brinks Gilson & Lione

(57) ABSTRACT

A liquid crystal display device includes: a liquid crystal panel including a pixel having red, green, blue and white sub-pixels; a mode selector selecting one from an RGB mode and an RGBW mode as a driving mode; an RGBW mode signal generating part performing a color correction on RGB input data corresponding to the pixel and converting the RGB input data into RGBW data in the RGBW mode; and an output controlling part outputting RGBW output data by performing a gamma conversion on the RGBW data in the RGBW mode and outputting the RGB input data and a W data for turning off the W sub-pixel as the RGBW output data in the RGB mode.

15 Claims, 3 Drawing Sheets

(56) References Cited

FOREIGN PATENT DOCUMENTS

| | | | |
|---|---|---|---|
| CN | 1987987 | A | 6/2007 |
| CN | 101419771 | A | 4/2009 |
| DE | 102005061305 | A1 | 11/2006 |
| KR | 1020080062185 | A | 7/2008 |
| WO | 2008/139766 | A1 | 11/2008 |

OTHER PUBLICATIONS

Office Action issued in corresponding Chinese Patent Application No. 201010238557.0, mailed Nov. 15, 2012.

Office Action issued in corresponding Korean Patent Application No. 10-2009-0095562, mailed Apr. 19, 2013.

Office Action issued in corresponding German Patent Application No. 102010036507.6, dated Sep. 16, 2013, 10 pages.

* cited by examiner

LIQUID CRYSTAL DISPLAY DEVICE INCLUDING DATA CONVERTING PART AND METHOD OF DRIVING THE SAME

This application claims the benefit of Korea Patent Application No. 10-2009-0095562, filed on Oct. 8, 2009, the entire contents of which is incorporated herein by reference for all purposes as if fully set forth herein.

BACKGROUND

1. Field of the Invention

The present disclosure relates to a liquid crystal display device, and more particularly, to a liquid crystal display device and a method of driving the liquid crystal display device.

2. Discussion of the Related Art

As information technology progresses, various demands for display devices displaying images have increased. Recently, flat panel display (FPD) devices such as a liquid crystal display (LCD) device, a plasma panel display (PDP) device, an electroluminescent display (ELD) device and a field emission display (FED) device have been used. Among various FPD devices, LCD devices have been widely used because of their advantage of a light weight, a thin profile and a low power consumption.

In general, an RGB type LCD device that includes red (R), green (G) and blue (B) sub-pixels as a single pixel has been widely used. However, the RGB type LCD device has a limit in brightness of displayed images. To surpass the above limit, an RGBW type LCD device that includes red (R), green (G), blue (B) and white (W) sub-pixels as a single pixel has been suggested. Since the W sub-pixel displays a white image without an additional color filter, the brightness of displayed images increases.

An RGBW type LCD device receives RGB data from an external system and converts the RGB data into RGBW data. The RGBW data is supplied to each sub-pixel to display an image. When the RGB data for an original image is converted into the RGBW data, various technologies for data conversion are adopted on the basis of color difference between the original image and the displayed image. Although the RGB data is converted on the basis of color difference, the W sub-pixel influences the adjacent R, G and B sub-pixels. As a result, the image displayed by the RGBW type LCD device still has color difference as compared with the original image. Accordingly, the RGBW type LCD device has a limit in displaying the original image without color difference.

BRIEF SUMMARY

A liquid crystal display device includes: a liquid crystal panel including a pixel having red, green, blue and white sub-pixels; a mode selector selecting one from an RGB mode and an RGBW mode as a driving mode; an RGBW mode signal generating part performing a color correction on RGB input data corresponding to the pixel and converting the RGB input data into RGBW data in the RGBW mode; and an output controlling part outputting RGBW output data by performing a gamma conversion on the RGBW data in the RGBW mode and outputting the RGB input data and a W data for turning off the W sub-pixel as the RGBW output data in the RGB mode.

In another aspect, a method of driving a liquid crystal display device having a liquid crystal panel including a pixel having red, green, blue and white sub-pixels includes: selecting one from an RGBW mode and an RGB mode; performing a color correction on RGB input data corresponding to the pixel and converting the RGB input data into RGBW data in the RGBW mode; and outputting RGBW output data by performing a gamma conversion on the RGBW data in the RGBW mode and outputting the RGB input data and a W data for turning off the W sub-pixel as the RGBW output data in the RGB mode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE DRAWINGS AND THE PRESENTLY PREFERRED EMBODIMENTS

Reference will now be made in detail to embodiments of the present invention, examples of which are illustrated in the accompanying drawings. Wherever possible, similar reference numbers will be used to refer to the same or similar parts.

Figure 1:
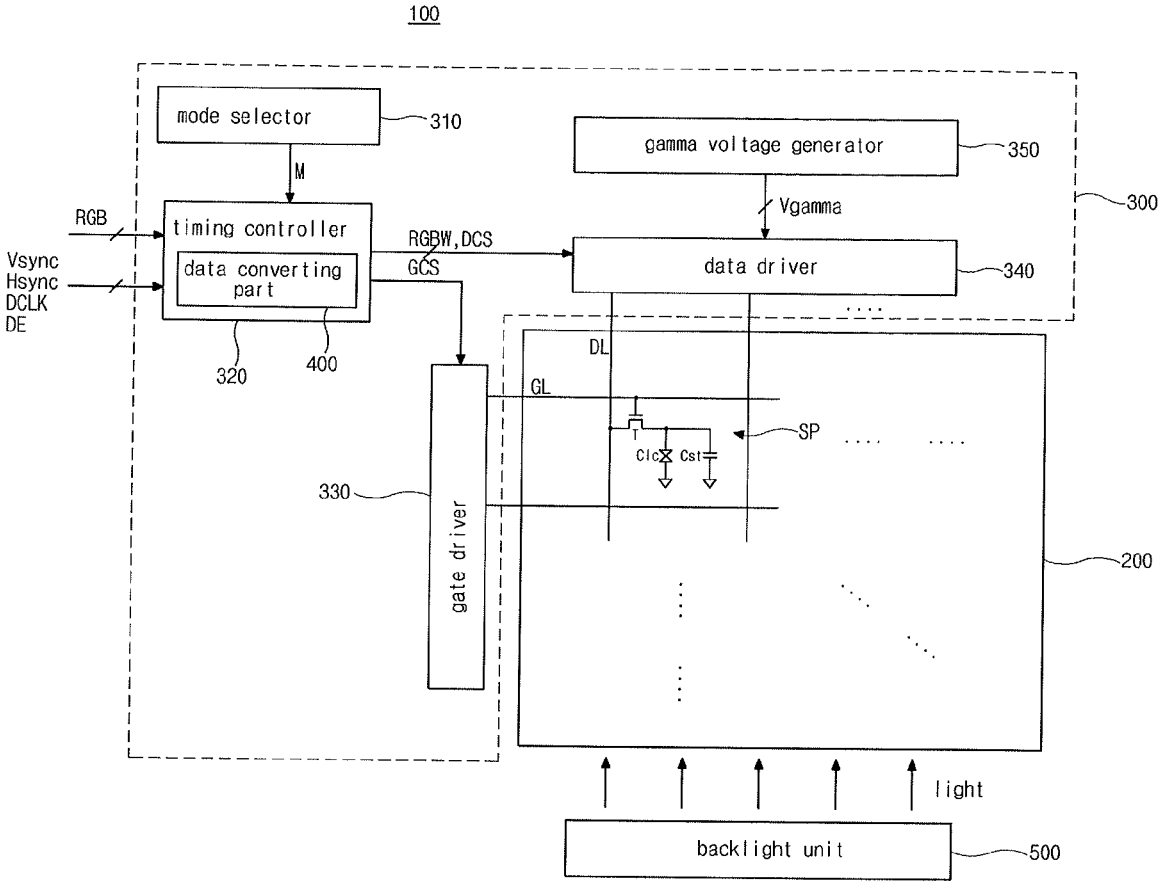
FIG. 1 is a view showing a liquid crystal display device according to an embodiment of the present invention.
Figure 2:
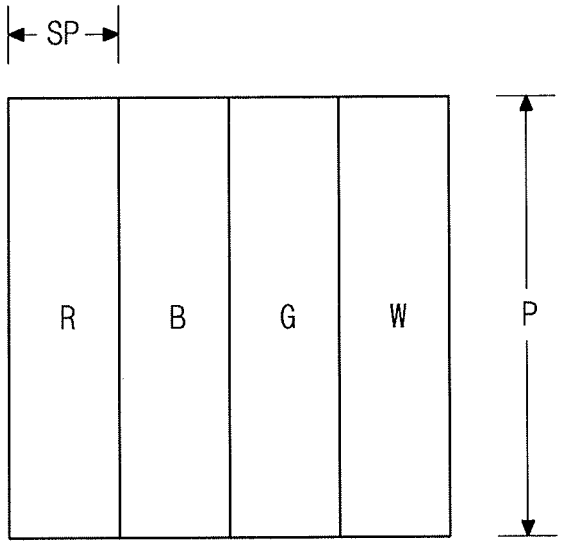
FIG. 2 is a view showing a single pixel of a liquid crystal display device according to an embodiment of the present invention.
Figure 3:
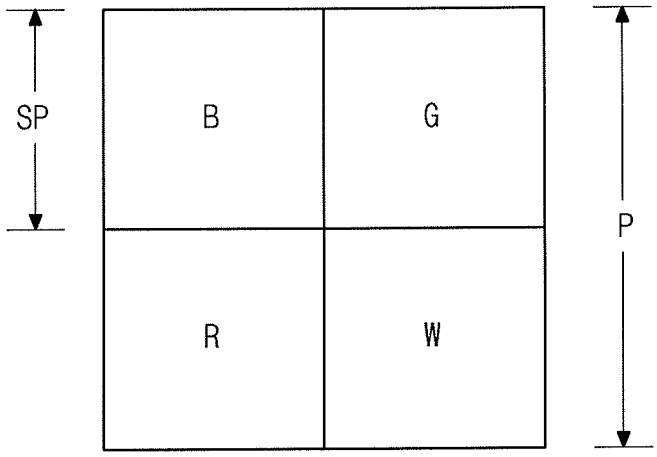
FIG. 3 is a view showing a single pixel of a liquid crystal display device according to another embodiment of the present invention.

FIG. 1 is a view showing a liquid crystal display device according to an embodiment of the present invention, FIG. 2 is a view showing a single pixel of a liquid crystal display device according to an embodiment of the present invention, and FIG. 3 is a view showing a single pixel of a liquid crystal display device according to another embodiment of the present invention.

In FIG. 1, a liquid crystal display (LCD) device 100 includes a liquid crystal panel 200, a driving circuit unit 300 and a backlight unit 500. The driving circuit unit 300 includes a mode selector 310, a timing controller 320, a gate driver 330, a data driver 340 and a gamma voltage generator 350.

The liquid crystal panel 200 having a plurality of pixels P includes a plurality of gate lines GL and a plurality of data lines DL. The plurality of gate lines GL cross the plurality of data lines DL to define a plurality of sub-pixels SP arranged in matrix. A thin film transistor (TFT) T is connected to the gate line GL and the data line DL in each sub-pixel SP, and a pixel electrode is connected to the TFT T. An electric field is generated between the pixel electrode and a common electrode corresponding to the pixel electrode, and a liquid crystal layer between the pixel electrode and the common electrode is driven by the electric field. The pixel electrode, the common electrode and the liquid crystal layer constitute a liquid crystal capacitor Clc. In addition, a storage capacitor Cst connected to the TFT T in each sub-pixel SP stores a data voltage applied to the pixel electrode till a next frame.

In FIGS. 2 and 3, a single pixel P defined as a minimal unit for displaying an image includes red (R), green (G), blue (B) and white (W) sub-pixels SP. The R, G, B and W sub-pixels SP may be horizontally arranged in a stripe type as shown in FIG. 2 or may be arranged in a quad type as shown in FIG. 3. The R, G, B and W sub-pixels SP may be variously arranged in another embodiment. Further, the R, G, B and W sub-pixels SP may be vertically arranged in a stripe type in another embodiment. The R, G, B and W sub-pixels correspond to red, green, blue and white data, respectively.

Referring again to FIG. 1, the timing controller 320 receives RGB data and a plurality of control signals from an external system (not shown). The RGB data corresponds to an original image. For example, the plurality of control signals may include a vertical synchronization signal Vsync, a horizontal synchronization signal Hsync, a clock signal DCLK and a data enable signal DE, and the external system may include a television system and a graphic card. In addition, the timing controller 320 may include a data converting part 400 that coverts the RGB data into RGBW data according to a driving mode. The RGBW data is supplied to the data driver 340.

The timing controller 320 generates a plurality of gate control signals GCS for controlling the gate driver 330 and a plurality of data control signals DCS for controlling the data driver 340 using the control signals. For example, the plurality of gate control signals GCS may include a gate start pulse signal GSP, a gate shift clock signal GSC and a gate output enable signal GOE, and the plurality of data control signals DCS may include a source start pulse signal SSP, a source shift clock SSC, a source output enable signal SOE and a polarity signal POL.

The gamma voltage generator 350 generates a plurality of gamma voltages Vgamma by distribution of a voltage difference between a high level voltage and a low level voltage. The plurality of gamma voltages Vgamma are supplied to the data driver 340.

The gate driver 330 supplies a gate voltage to the plurality of gate lines GL. The gate voltage includes a gate high voltage and a gate low voltage, and the gate high voltage is supplied sequentially to the plurality of gate lines GL according to the plurality of gate control signals GCS from the timing controller 300 in each frame. The TFT T is turned on by the gate high voltage, while the TFT T is turned off by the gate low voltage.

The data driver 340 generates a data voltage corresponding to the RGBW data from the timing controller using the plurality of gamma voltages Vgamma from the gamma voltage generator 350 and supplies the data voltage to the plurality of data lines DL according to the data control signals DCS from the timing controller 320. Accordingly, the data voltage is applied to the corresponding sub-pixel SP through the corresponding data line DL according to the gate high voltage of the gate voltage.

The backlight unit 500 supplies a light to the liquid crystal panel 200. The backlight unit 500 includes a light source such as a cold cathode fluorescent lamp (CCFL), an external electrode fluorescent lamp (EEFL) and a light emitting diode (LED).

The mode selector 310 determines a driving mode for the LCD device 100. For example, the mode selector 310 may select one from an RGB mode and an RGBW mode. In the RGB mode, the W sub-pixel is turned off not to emit a light and the R, G and B sub-pixels are driven according to the RGB data to display an image. Since the image is displayed according to the RGB data corresponding to the original image in the RGB mode, the image has an advantage in color quality. In the RGBW mode, the RGB data corresponding to the original image is converted into the RGBW data and the R, G, B and W sub-pixels are driven according to the RGBW data to display an image. Since the image is displayed according to the RGBW data, the image has an advantage in brightness. Accordingly, the LCD device 100 may be driven in the RGB mode on the basis of color quality or may be driven in the RGBW mode on the basis of brightness.

The selection from the RGB mode and the RGBW mode may be performed according to circumstances or a choice by a user.

The LCD device 100 may be driven in the RGB mode under a dark circumstance and may be driven in the RGBW mode under a bright circumstance. In addition, the mode selector 310 may include a photo sensor measuring the brightness of the circumstances and may generate a mode signal M according to the measured brightness of the circumstances. For example, the mode signal M may have a first state under a bright circumstance and may have a second state under a dark circumstance. When the measured brightness is equal to or greater than a reference brightness, the circumstances may be judged bright. In addition, when the measured brightness is smaller than the reference brightness, the circumstances may be judged dark.

Further, a user may select one from the RGB mode and the RGBW mode, and the LCD device 100 may be driven in the selected mode. For example, a user may select a driving mode through a display setting menu of a television. When a user selects a driving mode, the mode selector 310 may generate a mode signal M according to the selected driving mode. For example, the mode signal M may have a first state when an RGBW mode is selected and may have a second state when an RGB mode is selected.

When the mode selector 310 determines a driving mode, the data converting part 400 outputs the RGBW data corresponding to the driving mode. The data converting part 400 will be illustrated referring to FIGS. 4 and 5.

Figure 4:
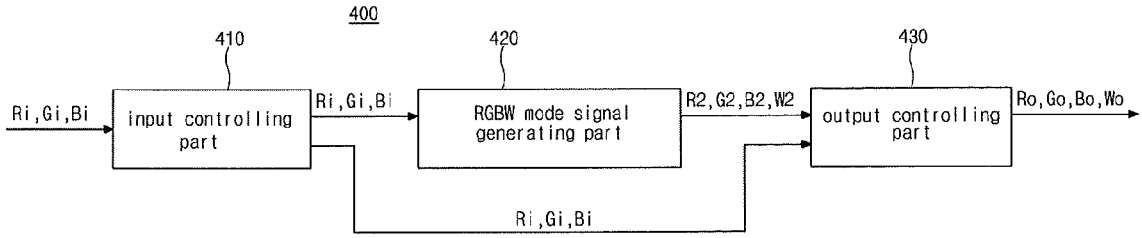
FIG. 4 is a view showing a data converting part of a liquid crystal display device according to an embodiment of the present invention.
Figure 5:
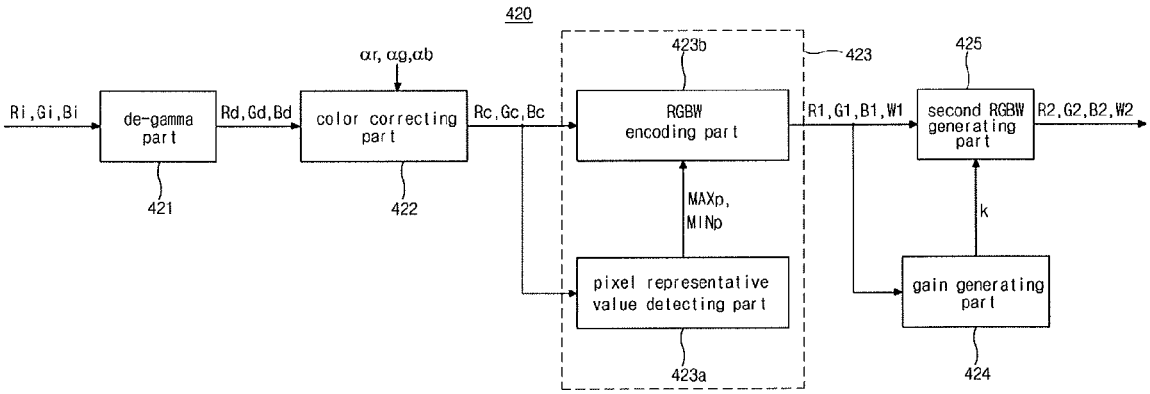
FIG. 5 is an RGBW mode signal generating part of a data converting part of a liquid crystal display device according to an embodiment of the present invention.

FIG. 4 is a view showing a data converting part of a liquid crystal display device according to an embodiment of the present invention, and FIG. 5 is an RGBW mode signal generating part of a data converting part of a liquid crystal display device according to an embodiment of the present invention.

In FIG. 4, the data converting part 400 includes an input controlling part 410, an RGBW mode signal generating part 420 and an output controlling part 430. The input controlling part 410 receives RGB input data Ri, Gi and Bi for each pixel and outputs the RGB input data Ri, Gi and Bi to one of the RGBW signal generating part 420 and the output controlling part 430 according to a driving mode. For example, when the LCD device 100 (of FIG. 1) is driven in the RGBW mode, the input controlling part 410 may output the RGB input data Ri, Gi and Bi to the RGBW mode signal generating part 420. In addition, when the LCD device 100 is driven in the RGB mode, the input controlling part 410 may output the RGB input data Ri, Gi and Bi to the output controlling part 430 with bypassing the RGBW mode signal generating part 420. The input controlling part 410 may synchronize the RGB input data Ri, Gi and Bi with a synchronization signal and may output the synchronized RGB input data Ri, Gi and Bi.

The RGBW mode signal generating part 420 is activated in the RGBW mode and converts the RGB input data Ri, Gi and Bi into second RGBW data R2, G2, B2 and W2 for each pixel. In FIG. 5, the RGBW mode signal generating part 420 includes a de-gamma part 421, a color correcting part 422, a first RGBW generating part 423, a gain generating part 424 and a second RGBW generating part 425. In addition, the first RGBW generating part 423 includes a pixel representative value detecting part 423*a* and an RGBW encoding part 423*b*.

The de-gamma part 421 linearizes the RGB input data R1, Gi and Bi from the input controlling part 410 to generate first RGB conversion data Rd, Gd and Bd for each pixel. The RGB input data Ri, Gi and Bi have a non-linear state produced by a gamma conversion on the basis of a gamma property (γ) of the liquid crystal panel 200 (of FIG. 1). Accordingly, the de-gamma part 421 performs a de-gamma conversion to linearize the RGB input data Ri, Gi and Bi. For example, the de-gamma conversion may be performed on the RGB input data Ri, Gi and Bi according to an equation (1) and the first RGB conversion data Rd, Gd and Bd may be obtained.

$$Rd=Ri^{\gamma},\ Gd=Gi^{\gamma},\ Bd=Bi^{\gamma} \quad (1)$$

Accordingly, the de-gamma part 421 generates the first RGB conversion data Rd, Gd and Bd that are the de-gamma converted (linearized) RGB input data Ri, Gi and Bi, respectively. Here, the data bit number may increase by the de-gamma conversion. For example, when each of the RGB input data Ri, Gi and Bi is an 8-bit signal, each of the first RGB conversion data Rd, Gd and Bd obtained by the de-gamma conversion may has a bit number (e.g., a 12-bit signal) greater than 8-bit.

The first RGB conversion data Rd, Gd and Bd are inputted to the color correcting part 422. The color correcting part 422 modulates the first RGB conversion data Rd, Gd and Bd according to the property of the liquid crystal panel 200. When the RGBW data having the same RGB ratio as the RGB data are supplied to the R, G, B and W sub-pixels, the RGBW mode LCD device may have a color difference from the RGB mode LCD device because of the W sub-pixel. To correct the color difference, the color correcting part 422 modulates the first RGB conversion data Rd, Gd and Bd to generate second RGB conversion data Rc, Gc and Bc for each pixel. For example, the first RGB conversion data Rd, Gd and Bd may be modulated according to an equation (2) and the second RGB conversion data Rc, Gc and Bc that are the de-gamma converted (linearized) and color corrected RGB input data Ri, Gi and Bi, respectively, may be obtained.

$$Rc=Rd/\alpha r,\ Gc=Gd/\alpha g,\ Bc=Bd/\alpha b \quad (2)$$

Here, color correction coefficients of R, G and B αr, αg and αb may be determined according to optical properties of the liquid crystal panel 200 and displayed images.

For example, when the LCD device 100 driven in an RGB mode displays a $255^{th}$ grey level with an 8-bit signal, the ratio of data voltages applied to the R, G and B sub-pixels RGB may be about 1:1:1. When the LCD device 100 is driven in an RGBW mode, the ratio of data voltages applied to the R, G, B and W sub-pixels may be about 0.83:1:0.76:0.8 due to the color correction, which is referred to as an alpha blending. Accordingly, the color difference between the original image by the RGB data and the displayed image by the RGBW data is reduced. In addition, the brightness of the displayed image is improved due to the W sub-pixel.

The second RGB conversion data Rc, Gc and Bc are inputted to the first RGBW generating part 423. The first RGBW generating part 423 generates first RGBW data R1, G1, B1 and W1 for each pixel using the second RGB conversion data Rc, Gc and Bc. The pixel representative value detecting part 423*a* of the first RGBW generating part 423 determines pixel representative values for each pixel from the second RGB conversion data Rc, Gc and Bc for each pixel. For example, the pixel representative value detecting part 423*a* may select a pixel data maximum MAXp and a pixel data minimum MINp from the second RGB conversion data Rc, Gc and Bc for each pixel according to an equation (3).

$$MAXp=\mathrm{Max}(Rc,Gc,Bc),\ MINp=\mathrm{Min}(Rc,Gc,Bc) \quad (3)$$

The pixel data maximum MAXp and the pixel data minimum MINp are inputted to the RGBW encoding part 423*b* of the first RGBW generating part 423. The RGBW encoding part 423*b* generates a first W data W1 for each pixel using the pixel data maximum MAXp and the pixel data minimum MINp. For example, the RGBW encoding part 423*b* may compare the pixel data maximum MAXp and the pixel data minimum MINp and may encode the first W data W1 according to the comparison result. In addition, the RGBW encoding part 423*b* encodes first RGB data R1, G1 and B1 for each pixel using the first W data W1. For example, the first RGB data R1, G1 and B1 may be obtained by subtracting the first W data W1 from the second RGB conversion data Rc, Gc and Bc or by multiplying a coefficient and a value obtained by subtracting the first W data W1 from the second RGB conversion data Rc, Gc and Bc. As a result, the first RGBW generating part 423 generates the first RGBW data R1, G1, B1 and W1 for each pixel using the second RGB conversion data Rc, Gc and Bc.

The first RGBW data R1, G1, B1 and W1 are inputted to each of the gain generating part 424 and the second RGBW generating part 425. The gain generating part 424 generates a gain k analyzing the first RGBW data R1, G1, B1 and W1 of a single frame for an image. For example, the gain generating part 424 may detect a frame maximum from grey levels of the first RGBW data R1, G1, B1 and W1 for a pixel. The frame maximum may be defined by a maximum of the grey levels of the first RGBW data R1, G1, B1 and W1 of a single frame excluding an allowable error limit of high grey levels. Accordingly, the frame maximum corresponds to a maximum of the grey levels of pixels except the allowable number of overflowed pixels. The frame maximum may be obtained may be obtained by a histogram analysis and a bitmap analysis.

In addition, the gain k may be generated by dividing a maximum grey level by the frame maximum according to an equation (4).

$$k=MAXg/MAXe \quad (4)$$

Here, MAXg and MAXe are the maximum grey level and the frame maximum, respectively.

When each of the first RGBW data R1, G1, B1 and W1 is a 12-bit signal, the maximum grey level MAXg is 4095.

The gain k may be obtained by analyzing the first RGBW data R1, G1, B1 and W1 of a previous frame. For the purpose of generating the gain k analyzing the first RGBW data R1, C1, B1 and W1 of a present frame, the first RGBW data R1, G1, B1 and W1 of the present frame should be completely inputted before the gain k is generated. Since the first RGBW data R1, C1, B1 and W1 of the previous frame are similar to the first RGBW data R1, G1, B1 and W1 of the present frame, the gain generating part 424 may generate the gain k using the first RGBW data R1, G1, B1 and W1 of the previous frame and the process time is reduced.

The gain k is inputted to the second RGBW generating part 425. The second RGBW generating part 425 generates the second RGBW data R2, G2, B2 and W2 by multiplying the gain k and the first RGBW data R1, G1, B1 and W1 according to an equation (5).

$$R2=k*R1,\ G2=k*G1,\ B2=k*B1,\ W2=k*W1 \quad (5)$$

As a result, when the LCD device 100 is driven in an RGBW mode, the RGB input data Ri, Gi and Bi (RGB data)

are converted into the second RGBW data R2, G2, B2 and W2 (RGBW data) by the RGBW mode signal generating part 420.

The second RGBW data R2, G2, B2 and W2 are inputted to the output controlling part 430. In an RGBW mode, since the second RGBW data R2, G2, B2 and W2 correspond to a linearized data by de-gamma conversion in the de-gamma part 421, the output controlling part 430 perform a gamma conversion on the second RGBW data R2, G2, B2 and W2 on the basis of a gamma property (γ) of the liquid crystal panel 200 (of FIG. 1). For example, the gamma conversion may be performed on the second RGBW data R2, G2, B2 and W2 according to an equation (6) and RGBW output data Ro, Go, Bo and Wo may be obtained.

$$Ro=R2^{1/\gamma},\ Go=G2^{1/\gamma},\ Bo=B2^{1/\gamma},\ Wo=W2^{1/\gamma} \quad (6)$$

As a result, the output controlling part 430 generates the RGBW output data Ro, Go, Bo and Wo each having a non-linear state.

Here, the data bit number may decrease by the gamma conversion. While the data bit number may increase by the de-gamma conversion as mentioned above, the data bit may decrease by the gamma conversion which is a reversed function of the de-gamma conversion. For example, when each of the second RGBW data R2, G2, B2 and W2 is a 12-bit signal, each of the RGBW output data Ro, Go, Bo and Wo obtained by the gamma conversion may has a bit number (e.g., an 8-bit signal) smaller than 12-bit. The RGBW output data Ro, Go, Bo and Wo are inputted to the data driver 340.

Therefore, when the LCD device 100 is driven in an RGBW mode, the data converting part 400 modulates the RGB input data Ri, Gi and Bi by de-gamma conversion and the color correction to reduce the color difference and generates the RGBW output data Ro, Go, Bo and Wo using the modulated RGB input data Ri, Gi and Bi.

Furthermore, when the LCD device 100 driven in an RGB mode, the data converting part 400 does not perform the de-gamma conversion and the color correction. Accordingly, the RGB input data Ri, Gi and Bi outputted from the input controlling part 410 bypass the RGBW mode signal generating part 420 and are inputted directly to the output controlling part 430. Since the de-gamma conversion is not performed on the RGB input data Ri, Gi and Bi, the RGB input data Ri, Gi and Bi have a non-linear state (gamma converted state) and the gamma conversion for the RGB input data Ri, Gi and Bi is omitted in the output controlling part 430. As a result, the output controlling part 430 outputs the RGB input data Ri, Gi and Bi as the RGB output data Ro, Go and Bo without the gamma conversion. In addition, the W output data Wo for turning off the W sub-pixel may be added to the RGB output data Ro, Go and Bo to constitute RGBW output data Ro, Go, Bo and Wo.

Therefore, when the LCD device 100 is driven in an RGB mode, the RGB output data Ro, Go and Bo corresponding to the RGB input data Ri, Gi and Bi are applied to the R, G and B sub-pixels, respectively. In addition, the W output data Wo corresponding to an off voltage is applied to the W sub-pixel. For example, a voltage corresponding to a $0^{th}$ grey level (a grey level for a black image) may be applied to the W sub-pixel. Accordingly, the LCD device 100 displays the original image in the RGB mode.

Consequently, the RGBW type LCD device according to the present invention is selectively driven in one of the RGB mode and the RGBW mode. When the RGBW type LCD device is driven in the RGB mode, the RGB data for the original image are applied to the R, G and sub-pixels, respectively, and the W sub-pixel is turned off. Accordingly, the RGBW type LCD device displays the original image without color difference in the RGB mode.

In addition, when the RGBW type LCD device is driven in the RGBW mode, the RGBW data is generated by modulating the RGB data with the color correction for reducing the color difference. Accordingly, the RGBW type LCD device displays an image having higher brightness with reduced color difference in the RGBW mode.

As a result, the RGBW type LCD device may be driven in the RGB mode when the color is important, and the RGBW type LCD device may be driven in the RGBW mode when brightness is important. Therefore, the RGBW type LCD device displays images consistent with the purpose.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A liquid crystal display device, comprising:

a liquid crystal panel including a pixel having red, green, blue and white sub-pixels;

an RGBW signal generating part that performs a color correction on RGB input data corresponding to the pixel and converting the RGB input data into RGBW data; and an output controlling part that outputs RGBW output data by performing a gamma conversion on the RGBW data, wherein the RGBW signal generating part comprises:

a de-gamma part that performs a de-gamma conversion on the RGB input data to generate first RGB conversion data;

a color correcting part that performs the color correction on the first RGB conversion data to generate second RGB conversion data, wherein the second RGB conversion data are obtained from the first RGB conversion data divided by red, green and blue color correction coefficients, respectively, and wherein the red, green and blue color correction coefficients are determined to be different from each other according to optical properties of the liquid crystal panel and displayed images;

a first RGBW generating part that generates first RGBW data using the second RGB conversion data;

a gain generating part that generates a gain for a present display frame, independent of a backlight, wherein the gain is generated by dividing a maximum grey level by a maximum of the first RGBW data of a previous display frame; and a second RGBW generating part that generates second RGBW data by multiplying the first RGBW data and the gain.

2. The device according to claim 1, wherein the output controlling part performs the gamma conversion on the second RGBW data.

3. The device according to claim 1, wherein the red, green, blue and white sub-pixels are arranged in one of a stripe type and a quad type.

4. The device according to claim 1, wherein the frame maximum is obtained by a histogram analysis and a bit map analysis.

5. The device according to claim 1, further comprising:

a mode selector that selects one from an RGB mode and an RGBW mode as a driving mode, wherein the RGBW signal generating part performs the color correction in the RGBW mode; and the output controlling part that outputs the RGB input data and a W data for turning off the W sub-pixel as the RGBW output data in the RGB mode.

6. The device according to claim 5, further comprising an input controlling part that outputs the RGB input data to the RGBW signal generating part in the RGBW mode and outputs the RGB input data to the output controlling part in the RGB mode.

7. The device according to claim 5, wherein the mode selector includes a photo sensor measuring a brightness of circumstances, wherein the mode selector selects the RGBW mode when the brightness of the circumstances is equal to or greater than a reference brightness, and wherein the mode selector selects the RGB mode when the brightness of the circumstances is smaller than the reference brightness.

8. The device according to claim 5, wherein the mode selector selects one from the RGBW mode and the RGB mode according to a user's choice.

9. A method of driving a liquid crystal display device having a liquid crystal panel including a pixel having red, green, blue and white sub-pixels, comprising:

selecting one from an RGBW mode and an RGB mode;

performing a de-gamma conversion on RGB input data to generate first RGB conversion data in the RGBW mode;

performing a color correction on first RGB conversion data to generate second RGB conversion data in the RGBW mode, wherein the second RGB conversion data are obtained from the first RGB conversion data divided by red, green and blue color correction coefficients, respectively, and wherein the red, green and blue color correction coefficients are determined to be different from each other according to optical properties of the liquid crystal panel and displayed images;

generating first RGBW data using the second RGB conversion data in the RGBW mode;

generating a gain independent of a backlight by using the first RGBW data in the RGBW mode; and generating second RGBW data by multiplying the first RGBW data and the gain in the RGBW mode; and outputting RGBW output data by performing a gamma conversion on the second RGBW data in the RGBW mode and outputting the RGB input data and a W data for turning off the W sub-pixel as the RGBW output data in the RGB mode.

10. The method according to claim 9, wherein the gamma conversion is performed on the second RGBW data.

11. The method according to claim 9, further comprising measuring a brightness of circumstances, wherein selecting one from the RGBW mode and the RGB mode comprises selecting the RGBW mode when the brightness of the circumstances is equal to or greater than a reference brightness and selecting the RGB mode when the brightness of the circumstances is smaller than the reference brightness.

12. The method according to claim 9, wherein selecting one from the RGBW mode and the RGB mode is performed according to a user's choice.

13. The method according to claim 9, wherein the red, green, blue and white sub-pixels are arranged in one of a stripe type and a quad type.

14. The method according to claim 9, wherein the gain for a present display frame is generated by dividing a maximum grey level by a maximum of the first RGBW data of a previous display frame.

15. The method according to claim 14, wherein the frame maximum is obtained by a histogram analysis and a bit map analysis.

* * * * *